US005921749A

United States Patent [19]

McLaurin et al.

[11] Patent Number: 5,921,749

[45] Date of Patent: Jul. 13, 1999

[54] VANE SEGMENT SUPPORT AND ALIGNMENT DEVICE

[75] Inventors: Leroy Dixon McLaurin, Winter Springs; John Derek Sizemore, Orlando, both of Fla.

[73] Assignee: Siemens Westinghouse Power Corporation, Orlando, Fla.

[21] Appl. No.: 08/734,886

[22] Filed: Oct. 22, 1996

[51] Int. Cl.[6] ..... F01D 9/04

[52] U.S. Cl. ..... 415/189; 415/209.4

[58] Field of Search ..... 415/136, 137, 415/189, 190, 209.2, 209.3, 209.4, 210.1; 60/39.32

[56] References Cited

U.S. PATENT DOCUMENTS

| | | | |
|---|---|---|---|
| 2,971,333 | 2/1961 | Mendelsohn et al. . | |
| 3,070,352 | 12/1962 | Welsh . | |
| 3,529,904 | 9/1970 | Scalzo et al. | 415/136 |
| 3,584,967 | 6/1971 | Zerlauth | 415/137 |
| 4,127,357 | 11/1978 | Patterson . | |
| 4,286,921 | 9/1981 | Donlan et al. . | |
| 4,604,030 | 8/1986 | Naudet . | |
| 4,890,978 | 1/1990 | McLaurin et al. . | |
| 5,141,394 | 8/1992 | Donlan . | |

FOREIGN PATENT DOCUMENTS

| | | |
|---|---|---|
| 0780545 | 6/1997 | European Pat. Off. . |

*Primary Examiner*—Christopher Verdier

[57] ABSTRACT

A support and alignment assembly for supporting and aligning a vane segment is provided. The support and alignment assembly comprises a torque plate which defines an opening for receiving an eccentric pin and a locking end member for receiving a lock socket member. An eccentric pin adjustably supported by the torque plate opening for supporting and aligning a vane segment is provided. A lock socket member adapted to securely receive the eccentric pin and rotated therewith, and adjustably engage the torque plate locking end is provided. The lock socket member receives the eccentric pin, such that when the eccentric pin is adjusted to align the vane segment, the lock socket member engages the torque plate locking end to secure the vane segment in the desired position.

11 Claims, 4 Drawing Sheets

VANE SEGMENT SUPPORT AND ALIGNMENT DEVICE

STATEMENT OF GOVERNMENT INTEREST

Development for this invention was supported in part by United States Department of Energy contract DE-FC21-95MC32267. Accordingly, the United States government has certain rights in the invention.

BACKGROUND OF THE INVENTION

1. Field of the Invention

This invention relates generally to combustion turbines and more particularly to combustion turbines having vane segment support and alignment mechanisms.

2. Description of the Prior Art

Conventional combustion turbines comprise a compressor section, a combustion section, and a turbine section. Additionally, an annular flow path for directing a working fluid through the compressor section, combustion section, and turbine section is provided.

The compressor section and turbine section are provided with alternating rows or stages of rotating blades and stationary vane segments. The blades in the compressor section rotate to compress air which is then directed by the stationary vane segments to add momentum to the working fluid. Combustible fuel is added to the compressed working fluid in the combustion section and then heated rapidly. The heating of this mixture produces a hot, high velocity gas which is exhausted through a nozzle and directed by turbine vane segments to impinge turbine blades within the turbine section. The turbine blades then rotate a shaft that is coupled to the compressor section to drive the compressor and compress more working fluid. The combustion turbine is also used to power an external load.

Generally, the net output of a conventional combustion turbine is the difference between the total power it produces and the power absorbed by the compressor section. Approximately two thirds of combustion turbine power is used to drive the compressor section. Thus, the overall performance of a combustion turbine is very sensitive to the efficiency of its compressor section. To ensure that a highly efficient high pressure ratio is maintained, a plurality of rotating blades are axially disposed along the shaft and interspersed with a plurality of inner shrouded stationary vane segments. The vane segments provide a diaphragm assembly having stepped labyrinth interstage seals.

Typically, vane segments are closely aligned radially between the inner and outer cylinders of a turbine to minimize the aerodynamic drag on vane segments. These aerodynamic forces act normally and tangentially upon the surfaces of the vane segments and generate torques and moments that are desirably transferred to the casing of the combustion turbine rather than through the vane segments. When these torques and moments, however, act upon the vane segments, the vane segments may be misaligned, thereby reducing the compressor efficiency.

It would therefore be desirable to provide a combustion turbine with improved efficiency.

SUMMARY OF THE INVENTION

A support and alignment assembly for supporting and aligning a vane segment is provided. The support and alignment assembly comprises a torque plate which is adapted to receive an eccentric pin. An eccentric pin is placed in adjustable communication with the torque plate such that the eccentric pin is in supporting and aligning communication with a vane segment. A locking member is placed in adjustable locking communication with the eccentric pin for locking the vane segment in alignment.

DETAILED DESCRIPTION OF THE PREFERRED EMBODIMENT(S)

Figure 1:
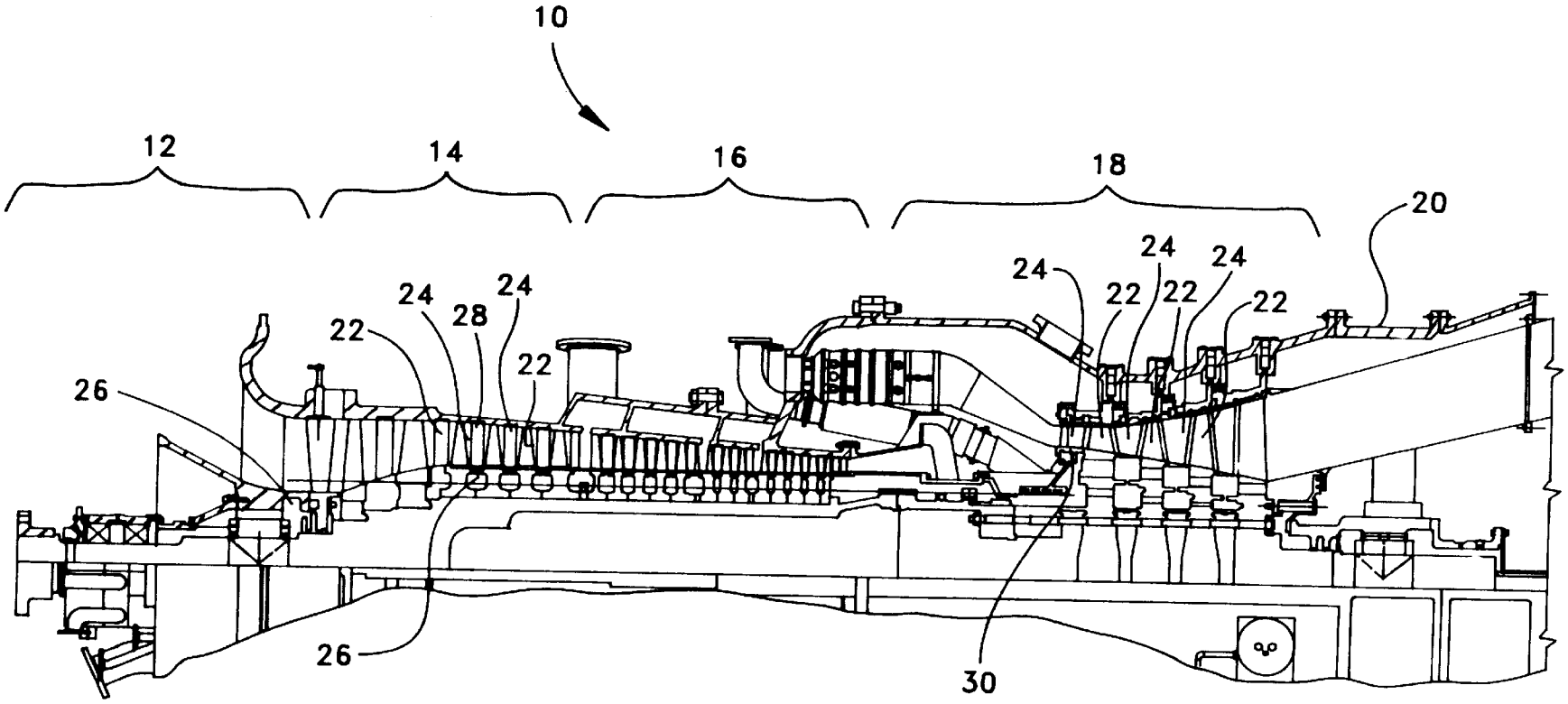
FIG. 1 is a partial cut-away view of a combustion turbine.

FIG. 1 shows a conventional combustion turbine 10. The combustion turbine 10 comprises an inlet section 12, a compressor section 14, a combustion section 16, and a turbine section 18 which are all generally enclosed by a casing 20.

The compressor section 14 and turbine section 18 are provided with alternating rows or stages of rotating blades 22 and stationary vane segments 24. The blades 22 are axially disposed about a rotor 26 and rotatably coupled to a shaft 28 that extends longitudinally through the combustion turbine 10.

The blades 22 in the compressor section rotate to compress air which is then directed by the stationary vane segments 24 to add momentum to the working fluid. Combustible fluid is added to the compressed working fluid in the combustion section 16 to produce a hot, high velocity gas. This hot, high velocity gas is exhausted through a nozzle and directed by the turbine vane segments 24 to impinge turbine blades 22 disposed along the shaft 28.

The stationary vane segments 24 and rotating blades 22 are arranged in alternating rows so that a row of vanes segments 24 and the immediately downstream row of blades 22 form a stage. The vane segments 24 serve to direct the flow of hot, high velocity gas so that it enters the downstream row of blades 22 at the correct angle.

Figure 2:
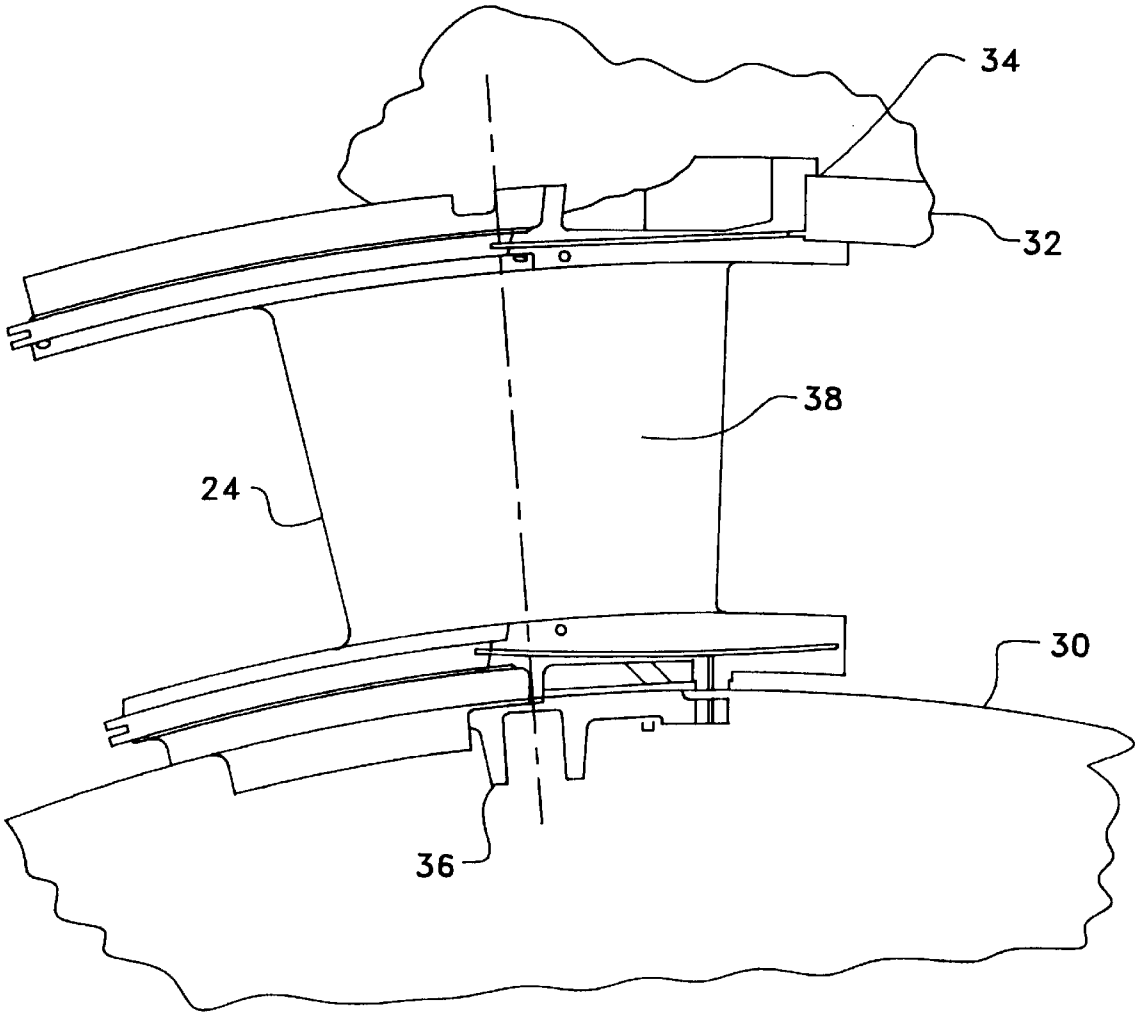
FIG. 2 illustrates one of a plurality of vane segments that are mounted in a combustion turbine.

FIG. 2 shows a single vane segment 24 supported and aligned circumferentially and radially with respect to the inner support ring 30 and outer cylinder 32 in the most desirable working position. The vane segment 24 comprises a fixed mounting portion 34 and an alignment slotted support portion 36 with an airfoil portion 38 therebetween. The vane segment 24 is mounted to the outer cylinder 32 along the vane segment fixed mounting portion 34, and adjustably supported at the inner support ring 30 along the vane segment slotted portion 36. The inner support ring 30 is mechanically coupled to an inner cylinder (not shown).

Figure 3:
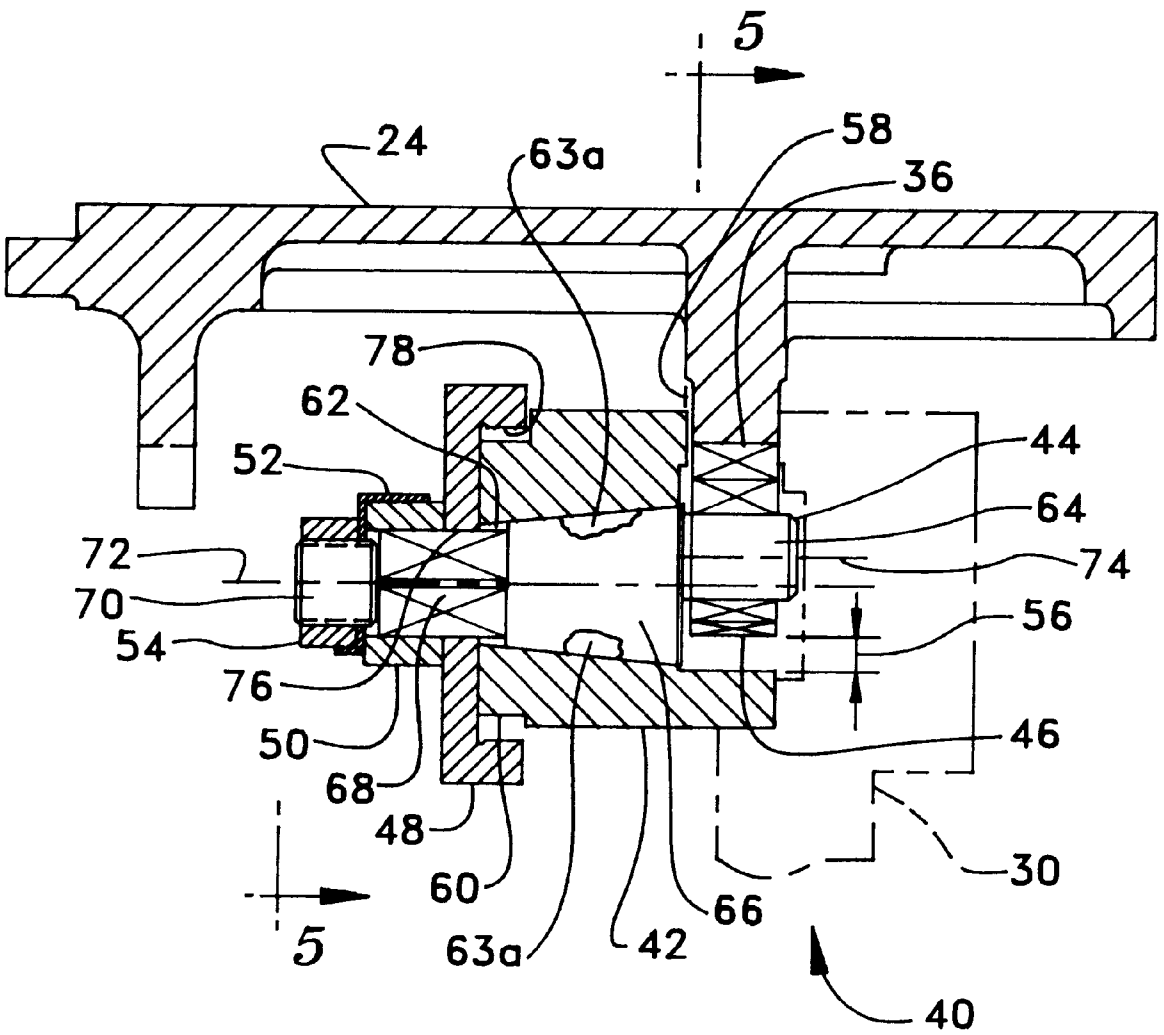
FIG. 3 is a sectional view of a vane segment support and alignment device in accordance with the present invention.

FIG. 3 shows a vane segment alignment assembly 40 mounted in accordance with the present invention for providing the necessary vane support and alignment capabilities along the vane segment slotted portion 36. The vane segment alignment assembly 40 comprises a torque plate 42, an eccentric pin 44, a generally square bushing 46, a locking member or lock socket 48, a spacer collar 50, a lock washer 52 and a hexagonal nut 54. With the vane segment alignment assembly mounted at the vane segment alignment slotted support portion, an area 56 for vane segment thermal growth and an area 58 for axial growth is present.

The eccentric pin 44 is formed to adjustably communicate with the torque plate 42 such that the eccentric pin adjustably supports and aligns the vane segment 24. The locking member 48 is formed to lockingly communicate with the eccentric pin 44 after the vane segment 24 is in the proper alignment position.

The torque plate 42 preferably defines a locking end 60, and a central opening 62. The locking end 60 is formed to receive a lock socket jagged edge opening 78. Preferably the locking end 60 is formed as a hexagonal edge. The central opening 62 is formed to adjustably support the eccentric pin and enable the eccentric pin to rotate therein. Preferably the central opening extends entirely through thus torque plate and is defined by the bore surface 63*a*. The torque plate 42 is secured to the inner support ring 30 such that the torque plate 42 transfers a substantial amount of the aerodynamic forces and moments produced in an operating turbine to the turbine casing 20.

The eccentric pin 44 preferably comprises at least a tapered pin end 64, generally tapered cylindrical body portion 66, generally square body portion 68, and pin tip 70. The generally tapered cylindrical body portion 66, generally square body portion 68, and pin tip 70 are coaxially aligned along a first axis 72, while the tapered pin end is aligned along a distinct second axis 74.

Preferably the eccentric pin square body portion 68 and tapered cylindrical body portion 66 are formed to be adjustably supported with the torque plate central opening 62. The tapered pin end 64 is formed to fit with the generally square bushing 46, which in turn fits within the vane segment slotted support portion 36. The vane segment slotted support 36, tapered pin end 64 and square bushing 46 are positioned above the thermal growth area 56 to allow for thermal expansion by the vane segment 24 when the combustion turbine is in operation. With the eccentric pin 44 properly positioned, the pin 44 may be rotated or adjusted to finely adjust the vane segment's position relative to the inner cylinder 30.

The locking member 48 preferably defines a central opening 76 and a jagged edge opening 78. The locking member central opening 76 is preferably adapted to securely fit around the eccentric pin square body portion 68 and rotate therewith. It is noted that the locking member socket central opening 76 may be formed in other configurations to enable the locking member central opening 76 to securely engage the eccentric pin square body portion 68 and rotate therewith. Preferably, the jagged edge opening 78 is adapted to adjustably engage the torque plate locking end 60 to lock or secure the eccentric pin 44 after the eccentric pin 44 is adjusted to align the vane segment 24. It is noted that the locking member 48 could be designed to lockingly engage any other surrounding part along the vane segment slotted portion to lock the vane segment in alignment. The locking member 48 is described in more detail below.

The spacer collar 50 is placed around the eccentric pin square body portion 68 and adjacent to the locking member 48. The lock washer 52 is positioned around the eccentric pin square body portion 68 and adjacent to the spacer collar 50, such that the spacer collar 50 is sandwiched between the lock washer 52 and locking member 48. The hexagonal nut 54 is securely positioned around the pin tip 70 and adjacent to the lock washer 52, such that the lock washer 52 is sandwiched between the hexagonal nut 54 and spacer collar 50. The hexagonal nut 54, lock washer 52, spacer collar 50 and locking member 48 are provided to secure the eccentric pin 44 within the torque plate 42.

Figure 4:
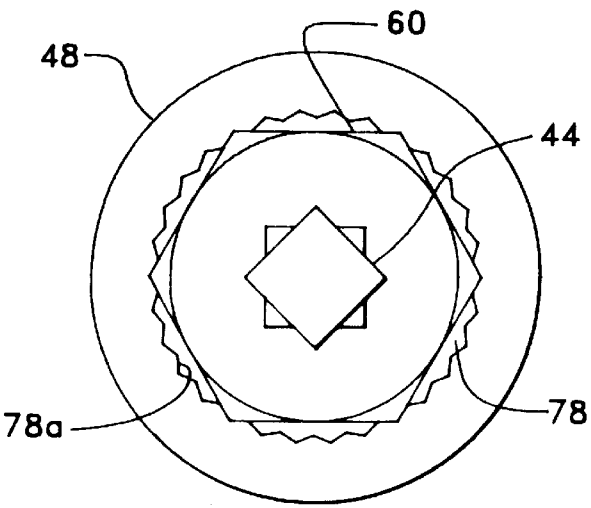
FIG. 4 shows a locking member jagged edge opening in accordance with the present invention.

FIG. 4 shows the locking member 48, jagged edge opening 78, torque plate hexagonal locking end 60 and taper pin 44 in locking engagement. Preferably, the jagged edge opening 78 comprises a thirty edge formation 78*a*, at substantially six degree increments. It is noted that the jagged edge opening 78 may have either more or less edges 78*a* formed therewith so long as the vane segment 24 is properly aligned. The jagged edge opening 78 is formed to rotatably engage and lock with the torque plate hexagonal locking end 60 as the eccentric pin 44 is rotated to adjust the vane segment alignment. The preferred edge formation 78*a* ensures that the vane segment 24 alignment is finely adjusted.

Figure 5:
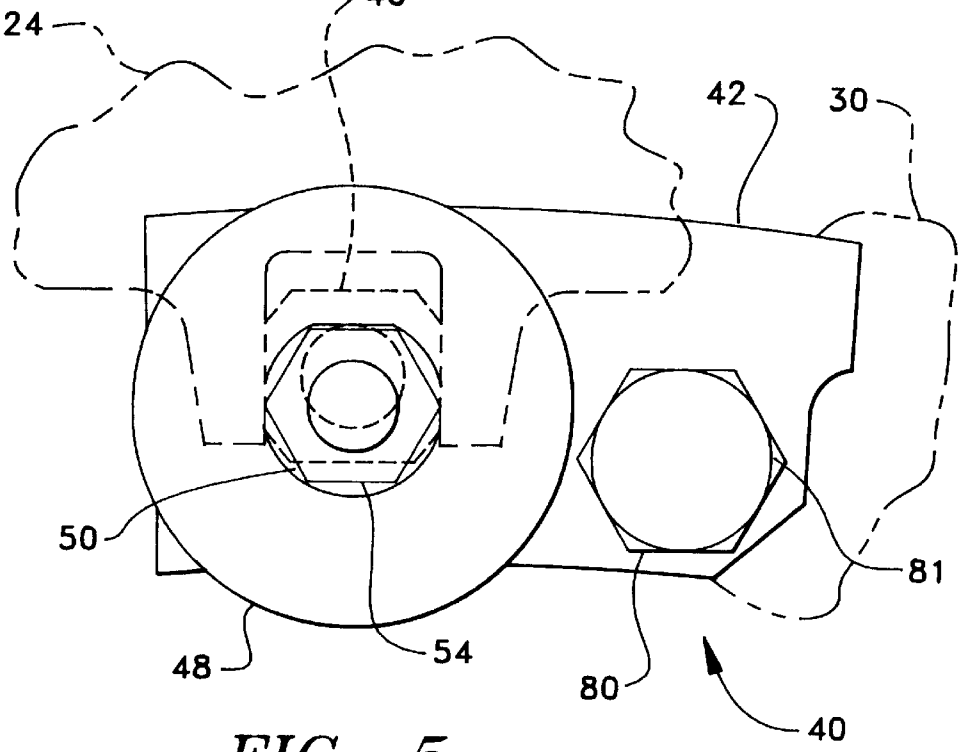
FIG. 5 is a section view taken along line 5—5 of the vane segment support and alignment device shown in FIG. 3.

FIG. 5 shows the vane segment and alignment assembly 40 adjustably supporting the vane segment slotted support portion 36 to the inner support ring 30 (shown in phantom lines). The eccentric pin 44 is shown removed from the assembly to more clearly illustrate the remaining elements of the vane support and alignment assembly 40. The torque plate 42 is mounted to the inner support ring 30 with one bolt 80 positioned through bolt hole 81. The generally square bushing 46 is placed within the vane segment support portion 36. The locking member 48 is positioned adjacent to the spacer collar 50. The hexagonal nut 54 is positioned adjacent to the locking member 48.

In operation, a plurality of vane segment support and alignment assemblies 40 are employed to support and align a plurality of vane segments 24 in a combustion turbine 10. The plurality of vane segments are closely aligned adjacent to one another circumferentially between the outer cylinder 32 and inner support ring 30. When each vane segment and alignment assembly 40 is in position, the lock member 48 restricts the eccentric pin 44 from rotating which, in turn, securely holds the vane segment in place during operation.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A support and alignment assembly for supporting and aligning a vane segment, said support and alignment assembly comprising:

a torque plate defining an opening for adjustably receiving an eccentric pin and a locking end member for receiving a lock socket member;

said eccentric pin adjustably supported by said torque plate opening and functioning to support and align said vane segment; and said lock socket member adapted to securely receive said eccentric pin in locking engagement therewith so as to rotate with the eccentric pin, and adjustably engage said torque plate locking end member, such that when said eccentric pin is adjusted to align said vane segment said lock socket member engages said torque plate locking end member to secure the vane segment.

2. The supporting and aligning assembly of claim 1 wherein said lock socket member further comprises:

a plurality of equidistant protruding edges that receive said torque plate locking end member.

3. The supporting and aligning assembly of claim 1 wherein said torque plate locking end member is hexagonal in shape.

4. The support and alignment assembly of claim 1 wherein said eccentric pin is comprised of a pin tip, a tapered cylindrical portion, a generally square body portion, and a tapered pin end, wherein said tapered cylindrical portion and generally square body portion share a common axis, distinct from said tapered pin end axis.

5. A support and alignment assembly for supporting and aligning a vane segment, said support and alignment assembly comprising:

a torque plate adapted to receive an eccentric pin;

said eccentric pin in adjustable communication with said torque plate and in supporting and aligning communication with said vane segment; and a locking member in adjustable locking communication with said eccentric pin and in adjustable locking communication with said torque plate for locking said vane segment in alignment.

6. The support and alignment assembly of claim 5 wherein said locking member comprises:

a plurality of equidistant protruding members for adjustably receiving said torque plate.

7. The support and alignment assembly of claim 6 wherein said torque plate comprises a hexagonal torque plate locking end member for receiving said locking member.

8. A combustion turbine comprising:

an inlet portion;

a turbine section having an outer cylinder and an inner cylinder;

a vane segment having a fixed mounting end and an adjustable support end, said vane segment fixed mounting end fixedly coupled to said outer cylinder, and said adjustable support end adjustably coupled to said inner cylinder; and a vane segment supporting and alignment assembly for supporting and aligning said vane segment at said vane segment adjustable support end and inner cylinder, said vane segment assembly comprising a torque plate adapted to receive an eccentric pin, said eccentric pin in adjustable communication with said torque plate and in supporting and aligning communication with said vane segment adjustable support end, and a locking member in locking engagement with said eccentric pin so as to rotate with the eccentric pin, and in adjustable locking communication with said torque plate for locking said vane segment in the proper alignment.

9. The combustion turbine in claim 3 wherein said locking member further comprises:

a plurality of equidistant protruding edges for adjustably receiving said torque plate.

10. The combustion turbine in claim 8 wherein said torque plate has a hexagonal locking end member.

11. The combustion turbine in claim 3 wherein said torque plate defines a central opening, and said eccentric pin is adapted to be in adjustable communication with said torque plate central opening.

* * * * *